US008353281B2

(12) United States Patent
Oberhomburg et al.

(10) Patent No.: US 8,353,281 B2
(45) Date of Patent: Jan. 15, 2013

(54) CONTROL ARRANGEMENT FOR A GAS STOVE

(75) Inventors: Martin Oberhomburg, Wetter (DE); Emilio Placer Maruri, Liencres (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 305 days.

(21) Appl. No.: 12/664,074

(22) PCT Filed: Jun. 11, 2008

(86) PCT No.: PCT/EP2008/057318

§ 371 (c)(1),
(2), (4) Date: Dec. 11, 2009

(87) PCT Pub. No.: WO2008/155278

PCT Pub. Date: Dec. 24, 2008

(65) Prior Publication Data

US 2010/0180882 A1 Jul. 22, 2010

(30) Foreign Application Priority Data

Jun. 21, 2007 (ES) ..... 200701823

(51) Int. Cl.
*F24C 3/12* (2006.01)

(52) U.S. Cl. ..... 126/39 BA; 126/39 E; 126/39 R; 126/39 G; 431/66

(58) Field of Classification Search ..... 126/39 BA, 126/39 E, 39 G, 39 R, 74, 78
See application file for complete search history.

(56) References Cited

U.S. PATENT DOCUMENTS

| | | | | |
|---|---|---|---|---|
| 4,380,698 | A * | 4/1983 | Butts | 219/492 |
| 5,575,638 | A | 11/1996 | Witham et al. | |
| 5,924,857 | A * | 7/1999 | Frasnetti et al. | 431/6 |
| 6,116,230 | A * | 9/2000 | Clifford et al. | 126/39 BA |
| 6,322,352 | B1 * | 11/2001 | Zink | 431/27 |
| 7,255,100 | B2 * | 8/2007 | Repper et al. | 126/39 BA |
| 2002/0045142 | A1 * | 4/2002 | Repper et al. | 431/66 |
| 2002/0073985 | A1 | 6/2002 | Leukhardt, III et al. | |
| 2005/0089809 | A9 * | 4/2005 | Repper et al. | 431/66 |
| 2006/0016444 | A1 * | 1/2006 | Clauss et al. | 126/39 E |

FOREIGN PATENT DOCUMENTS

| | | | |
|---|---|---|---|
| DE | 4133660 | A1 | 4/1993 |
| DE | 9407567 | U1 | 7/1994 |
| EP | 0135157 | A2 | 3/1985 |
| GB | 2100488 | A | 12/1982 |
| WO | 2009/040115 | A2 | 4/2009 |

* cited by examiner

*Primary Examiner* — Alfred Basichas
(74) *Attorney, Agent, or Firm* — James E. Howard; Andre Pallapies

(57) ABSTRACT

A control arrangement for a gas stove, wherein the control arrangement includes a gas burner; a control element to switch the gas burner on and off; a signal transducer to generate a first signal that depends on a position of the control element; a first control apparatus to control, depending on the first signal of the signal transducer, igniting or extinguishing a flame on the gas burner; and a second control apparatus that is arranged between the signal transducer and the first control apparatus. In at least one position of the control element, a second signal is fed to the first control apparatus that simulates continuous switching on and off of the gas burner.

19 Claims, 1 Drawing Sheet

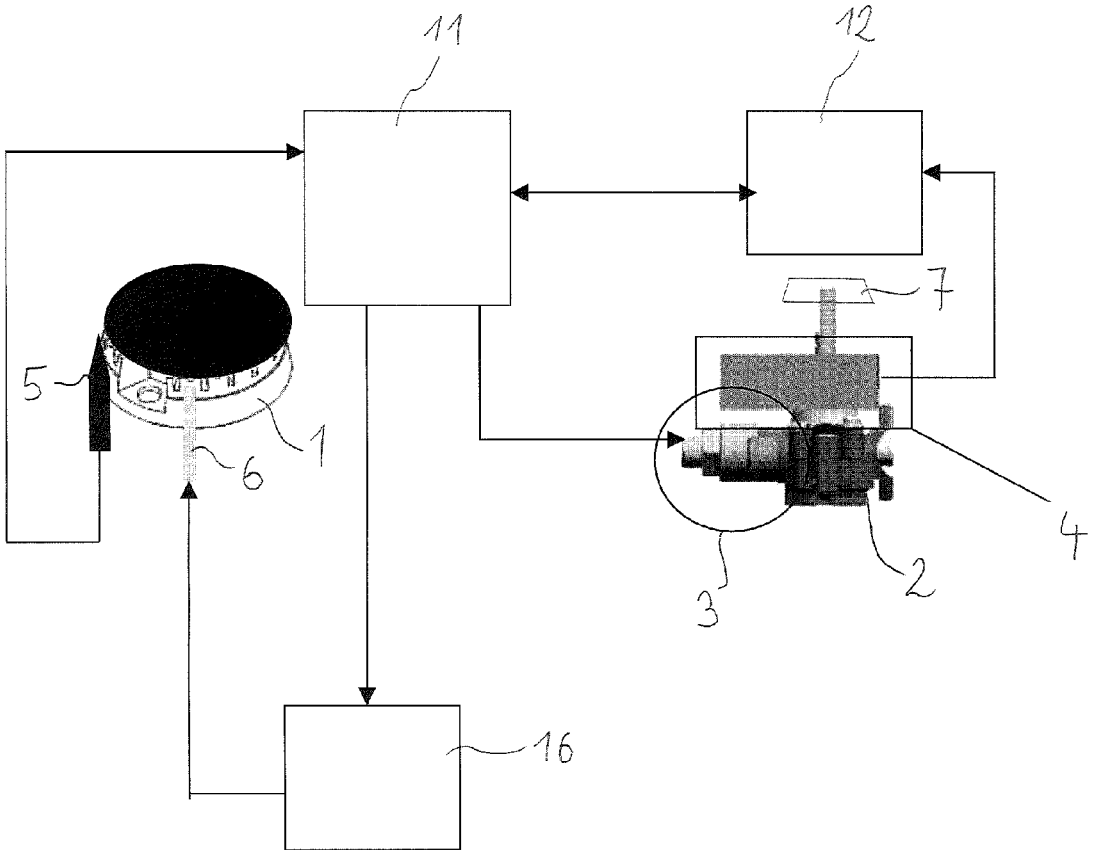
11
12
7
5
1
6
4
3
2
16

CONTROL ARRANGEMENT FOR A GAS STOVE

BACKGROUND OF THE INVENTION

The subject matter of the invention is a control arrangement for a gas stove having at least one gas burner, with the control arrangement comprising at least one control element for switching the gas burner on and off, at least one signal transducer generating a signal depending on the position of the control element and at least one first electrical control apparatus controlling the ignition or extinguishing of a flame on the gas burner depending on the signal of the signal transducer.

Control arrangements of the said type are embodied such that an operator is able to control the switching on and off of the gas burner and the adjustment of the flame size by rotating the control element. In particular, the gas burner can also be switched on by simply rotating the control element, it is not necessary to push the control element in an axial direction or to hold it in a certain position.

The switching on and off of the gas burner is completely controlled by the first control apparatus as a function of the output signal of the, as a rule, electrical signal transducer on the control element. Aside from the signal of the signal transducer on the control element, the first control apparatus also analyzes a signal from a flame monitor. The signal of the flame monitor further specifies whether or not a flame is present on the burner. The first control apparatus thereupon controls a shut-off valve and an ignition apparatus. The ignition apparatus allows sparks to be generated in the region of the burner in order to ignite the gas escaping from the burner. The shut-off valve is arranged in the gas path upstream of a flow control valve, which is likewise actuated with the control element. The shut-off valve is spring-loaded in the closed position and can be electromagnetically opened against the spring force. The electromagnet for opening the shut-off valve is controlled by the first control apparatus.

In the case of prior art gas stoves equipped with generic control arrangements, the burner power is controlled exclusively with the flow control valve which can be actuated with the control element. The flow cross-section in the flow control valve can be continuously adjusted here by the operator. The flow cross-section in the flow control valve is fixedly preset for the smallest possible burner capacity, for instance by means of its own flow channel.

The publications EP 1 215 441 A2 and U.S. Pat. No. 5,575,638 also disclose reducing the heat quantity output by the burner in a gas stove to below the smallest burner power which is inherent to the design. To this end, the flame on the burner is continuously ignited and extinguished again so that an average heat capacity is produced over time, which is less than the power of the burner with the smallest flame. These prior art control arrangements nevertheless require specially adjusted components, for instance a shut-off valve with two magnetic coils, or they are not suited to operation with a flame monitor.

BRIEF SUMMARY OF THE INVENTION

The object underlying the present invention is therefore to provide a generic control arrangement for a gas stove, which easily enables a reduction in the burner power with an otherwise unchanged functionality.

This object is achieved in accordance with the invention such that a second control apparatus is arranged between the electrical signal transducer and the first control apparatus, which is embodied such that, in at least one position of the control element, a signal is fed to the first control apparatus simulating a continuous switching on and off. With the inventive control arrangement, the heat capacity of the burner is reduced such that the burner is continuously ignited and extinguished again. All components of a generic control arrangement can be reused here unchanged. To achieve the desired functionality of the power reduction, a second control apparatus is interconnected between the electrical signal transducer and the first control apparatus. This second control apparatus analyzes the signal from the signal transducer. If a power reduction of the burner to below the minimal burner power with a constantly smallest flame is predetermined with the signal of the signal transducer, a continuous switching on and off by means of the control element is simulated by the second control apparatus. Here a signal is fed to the first control apparatus by the second control apparatus, said signal corresponding to the signal if, with a generic arrangement, the operator continuously switches the burner on and off by means of the operating element. To achieve the required functionality of a reduced burner capacity, no changes are therefore necessary with the first control apparatus.

At least one flow control change with a variable flow cross-section is preferably provided, which can be actuated with the control element. The operator controls the gas flow to the gas burner and thus the flame size by way of the flow control valve.

The inventive arrangement can likewise be used if at least one flame monitor is provided, which generates an electrical signal as a function of the presence of a flame on the gas burner, said signal being fed to the first control apparatus. The flame monitor may be embodied as a thermoelement for instance, which generates an electrical voltage, while a flame is present on the burner.

Furthermore, at least one shut-off valve can be provided, which can be controlled by the first control apparatus. The shut-off valve is used to interrupt the gas supply upstream of the flow control valve. This takes place for instance if the burner is switched off or if no flame is signaled by the flame monitor over long periods of time despite an open flow control valve. A conventional shut-off valve can be used in the inventive control arrangement, said shut off valve being pretensioned in the closed position by means of the force of a spring. The shut-off valve can be opened electromagnetically, thereby comprising a single coil, to which voltage is applied in order to open the shut-off valve by the first control apparatus.

At least one ignition apparatus is provided for the gas burner, said ignition apparatus likewise expediently being controllable by the first control apparatus. A spark can be generated with the ignition apparatus in the region of the gas outlet openings of the gas burner, said spark igniting the gas escaping from the burner. The first control apparatus can thus completely control the ignition process of the gas burner. This includes the opening of the shut-off valve, the ignition of the escaping gas by means of the ignition apparatus and the monitoring of the occurrence of a flame by means of the flame monitor.

According to an expedient embodiment, the first control apparatus and the second control apparatus are embodied as separate modules. The first control apparatus can thus be used unchanged for the generic and for inventive control arrangements. To obtain a control arrangement with the possibility of reducing power, the second control apparatus is switched between the signal transducer and the first control apparatus. The input signal of the first control apparatus is then no longer directly supplied by the signal transducer on the control element, but instead by the second control apparatus.

It is likewise possible for the second control apparatus and the first control apparatus to form a module. For instance, the two control apparatuses can be combined in a common housing.

The output signal of the second control apparatus, which is fed to the first control apparatus, is particularly preferably a discrete on/off signal. This on/off signal specifies the desired state of the burner, i.e. whether this is to be switched on or off. The first control apparatus then produces the desired state of the burner. If the output signal of the second control apparatus changes continuously, this results in the first control apparatus correspondingly continuously switching the burner on and off.

According to another possible embodiment, the second control apparatus is connected to the first control apparatus by way of a data bus. The data bus represents a defined interface between the control apparatuses and enables further information to be transmitted in addition to the on/off signal.

A particularly favorable design of the signal transducer is achieved if the signal transducer generates a multistage discrete signal as a function of the position of the control element. The different stages of the multistage discrete signal may mean for instance: burner off, burner on without power reduction, power reduction stage 1, power reduction stage 2, etc. The multistage discrete signal can be generated for instance by electrical resistors being connected in the signal transducer as a function of the position of the control element.

The second control apparatus is embodied here such that a certain ratio between the switch-on time and the switch-off time of the burner is assigned to the relevant stages of the discrete signal of the signal transducer. The ratio between the switch-on time and the switch-off time determines the average combustion power of the burner over time.

The gas stove particularly advantageously comprises two or more burners, for which a common first control apparatus is provided. The first control apparatus comprises correspondingly many electrical signal inputs and signal outputs to be able to control the said functions separately for each burner.

It is likewise advantageous for the gas stove to comprise two or more control elements with electrical signal transducers, which are assigned to a common second control apparatus. The function of the power reduction can thus be controlled for several burners using one signal second control apparatus. The input signals from several signal transducers are accordingly analyzed in one single second control apparatus.

DETAILED DESCRIPTION OF EXEMPLARY EMBODIMENTS OF THE PRESENT INVENTION

Further advantages and details of the invention are described in more detail with reference to the exemplary embodiment illustrated in the schematic FIGURE.

An inventive control arrangement for a gas stove with a control element (7), a flow control valve (2), a first electrical control apparatus (11), a second electrical control apparatus (12), an ignition module (16) and the electrical lines belonging to the control arrangement is shown. A shut-off valve (3) and an electrical signal transducer (4) are arranged on the flow control valve (2). A flame monitor (5) and an ignition electrode (6) are located in the region of a gas burner (1). For reasons of clarity, the gas lines were not shown.

The control element (7) on the flow control valve (2) indicates to the operator whether the burner (1) is to be switched on or off and the power level the burner (1) is to output. The operator here controls the opening cross-section of the flow control valve (2) by means of the control element (7). Furthermore, the position of the control element (7) is detected by means of the electrical signal transducer (4). The burner is switched on and off based on the electrical output signal of the signal transducer (4) by means of the control apparatuses (11) and (12).

The output signal of the signal transducer (4) consists of an electrical resistance value, which is measured by the second control apparatus (12). This resistance signal which is fed to the first control apparatus (11) is converted into a digital on/off signal by the second control apparatus (12).

If the operator has switched off the burner by means of the control element (7), the signal transducer (4) supplies a corresponding resistance signal, which is converted into a constant "off" signal by the second control apparatus. This first control apparatus (11) allows the burner to be switched off, i.e. the shut-off valve (3) remains closed and the ignition apparatus (16) is not activated.

If the control person uses the control element (7) to adjust the burner to a power which lies between the maximum and minimum burner capacity, the signal transducer (4) supplies a second resistance value. The second control apparatus (12) converts this second resistance value into a constant "on" signal. The first control apparatus (11) thereupon opens the shut-off valve (3), actuates the ignition apparatus (16) and monitors the presence of a flame on the burner (1) by means of the flame monitor (5). The first control apparatus automatically closes the shut-off valve (3), if it does not succeed in igniting a flame on the burner (1) or if the flame extinguishes and renewed ignition attempts fail.

If the operator uses the control element (7) to adjust the power of the burner (1) to a value which is less than the minimal burner power which is inherent in the design, the signal transducer (4) supplies a third resistance value. The third resistance value is converted by the second control apparatus (12) such that the first control apparatus (12) is alternately supplied with an "on" signal and "off" signal. This results in the first control apparatus (11) continuously switching the burner on and off. The control apparatus (11) automatically controls the opening and closing of the shut-off valve (3) and the ignition of the flame by means of the ignition apparatus. In this mode of operation the flow control valve (2) is adjusted to a minimal burner capacity.

To operate the burner with a power less than the minimal burner power which is inherent in the design, several power stages can be provided, which can be predetermined by means of the control element (7). A certain resistance value is assigned here to each power stage in the signal transducer (4). The heat output power of the burner is then controlled accordingly by the second control apparatus (12) by the ratio of the switch-on time to the switch-off time of the burner. A gradual variation in the ratio of the switch-on time to the switch-off time between 80:20 and 20:80 is conceivable for instance.

Instead of a signal transducer (4) supplying a discrete stage signal, a continuously operating signal transducer, for instance a potentiometer, can also be used. The ratio of the switch-on time to the switch-off time can then be varied continuously by the second control apparatus (12). The operating state in which the burner burns continuously can be defined when using a continuously operating signal transducer by a lower and upper limit value for the output signal of the signal transducer.

The invention claimed is:

1. A control arrangement for a gas stove, comprising:

a gas burner that produces a flame from a flow of gas;

a flow control valve that controls the flow of gas between a zero gas flow rate, a minimum continuous gas flow rate, and a maximum continuous gas flow rate;

a control element to switch the gas burner between a maximum on position, a minimum on position, and an off position;

a signal transducer to generate a first signal that depends on a position of the control element;

a first control apparatus to control, depending on the first signal of the signal transducer, igniting and extinguishing of the flame of the gas burner; and a second control apparatus arranged between the signal transducer and the first control apparatus and structured such that, in the minimum on position of the control element, a second signal is fed to the first control apparatus that causes the first control apparatus to intermittently ignite and extinguish the flame while the flow control valve switches between only the minimum continuous flow rate and the zero gas flow rate, wherein the zero gas flow rate, the minimum continuous gas flow rate, and the maximum continuous gas flow rate are each different gas flow rates.

2. The control arrangement of claim 1, further comprising a flame monitor to generate a third signal that is fed to the first control apparatus, depending on whether or not a flame is present.

3. The control arrangement of claim 1, further comprising a shut-off valve, wherein the first control apparatus controls the shut-off valve.

4. The control arrangement of claim 1, further comprising an ignition apparatus for the gas burner, wherein the first control apparatus controls the ignition apparatus.

5. The control arrangement of claim 1, wherein the first control apparatus and the second control apparatus form separate modules.

6. The control arrangement of claim 1, wherein the first control apparatus and the second control apparatus form one module.

7. The control arrangement of claim 1, wherein an output signal of the second control apparatus, which is fed to the first control apparatus, is a discrete on/off signal.

8. The control arrangement of claim 1, further comprising a data bus that connects the first control apparatus to the second control apparatus.

9. The control arrangement of claim 1, further comprising a common first control apparatus for at least two gas burners.

10. The control arrangement of claim 1, wherein a common second control apparatus is assigned to at least two control elements having respective signal transducers.

11. The control arrangement of claim 1, wherein the signal transducer generates a multistage discrete signal as a function of the position of the control element.

12. The control arrangement of claim 11, wherein the second control apparatus assigns a stage of the multistage discrete signal of the signal transducer to a respective ratio between a switch-on time and a switch-off time of the gas burner.

13. The control arrangement of claim 1, wherein the flow control valve has a variable flow cross-section, and the control element actuates the flow control valve.

14. The control arrangement of claim 13, wherein the flow control valve controls the flow of gas between the zero gas flow rate, the minimum continuous gas flow rate, a plurality of intermediate continuous gas flow rates, and the maximum continuous gas flow rate, and the control element switches the gas burner between the maximum on position, a plurality of intermediate on positions, the minimum on position, and the off position.

15. The control arrangement of claim 1, wherein the flow control valve controls the flow of gas between the zero gas flow rate, the minimum continuous gas flow rate, a plurality of intermediate continuous gas flow rates, and the maximum continuous gas flow rate, and the control element switches the gas burner between the maximum on position, a plurality of intermediate on positions, the minimum on position, and the off position.

16. A control arrangement for a gas stove, comprising:

a gas burner that produces a flame from a flow of gas;

a flow control valve that controls the flow of gas between a zero gas flow rate, a minimum continuous gas flow rate, and a maximum continuous gas flow rate;

a control element to switch the gas burner between a maximum on position, a minimum on position, and an off position;

a signal transducer to generate a first signal that depends on a position of the control element;

a first control apparatus that controls, depending on the first signal of the signal transducer, igniting and extinguishing of the flame of the gas burner; and a second control apparatus that receives the first signal from the signal transducer and produces a second signal when the control element is in the minimum on position, generates a second signal, and sends the second signal to the first control apparatus, the second signal instructing the first control apparatus to intermittently ignite and extinguish the flame while the flow control valve switches between only the minimum continuous flow rate and the zero gas flow rate, wherein the zero gas flow rate, the minimum continuous gas flow rate, and the maximum continuous gas flow rate are each different gas flow rates.

17. The control arrangement of claim 16, wherein the flow control valve controls the flow of gas between the zero gas flow rate, the minimum continuous gas flow rate, a plurality of intermediate continuous gas flow rates, and the maximum continuous gas flow rate, and the control element switches the gas burner between the maximum on position, a plurality of intermediate on positions, the minimum on position, and the off position.

18. The control arrangement of claim 16, wherein the flow control valve has a variable flow cross-section, and the control element actuates the flow control valve.

19. The control arrangement of claim 18, wherein the flow control valve controls the flow of gas between the zero gas flow rate, the minimum continuous gas flow rate, a plurality of intermediate continuous gas flow rates, and the maximum continuous gas flow rate, and the control element switches the gas burner between the maximum on position, a plurality of intermediate on positions, the minimum on position, and the off position.

* * * * *

UNITED STATES PATENT AND TRADEMARK OFFICE

CERTIFICATE OF CORRECTION

PATENT NO. : 8,353,281 B2
APPLICATION NO. : 12/664074
DATED : January 15, 2013
INVENTOR(S) : Oberhomburg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 340 days.

Signed and Sealed this
First Day of September, 2015

Michelle K. Lee

Michelle K. Lee
*Director of the United States Patent and Trademark Office*